US010529469B2

(12) United States Patent
Wannerskog et al.

(10) Patent No.: US 10,529,469 B2
(45) Date of Patent: Jan. 7, 2020

(54) PROCESS FOR MANUFACTURING A POWER CABLE AND POWER CABLE OBTAINABLE THEREOF

(71) Applicant: BOREALIS AG, Vienna (AT)

(72) Inventors: Asa Wannerskog, Gothenburg (SE); Francisco Galante, Madrid (ES); Peter Walter, Savedalen (SE); Ola Fagrell

(73) Assignee: BOREALIS AG, Vienna (AT)

( * ) Notice: Subject to any disclaimer, the term of this patent is extended or adjusted under 35 U.S.C. 154(b) by 0 days.

(21) Appl. No.: 15/780,998

(22) PCT Filed: Dec. 9, 2016

(86) PCT No.: PCT/EP2016/080379
§ 371 (c)(1),
(2) Date: Jun. 1, 2018

(87) PCT Pub. No.: WO2017/102575
PCT Pub. Date: Jun. 22, 2017

(65) Prior Publication Data

US 2019/0348199 A1 Nov. 14, 2019

(30) Foreign Application Priority Data

Dec. 18, 2015 (EP) ..... 15201031

(51) Int. Cl.

| | |
|---|---|
| ***H01B 13/14*** | (2006.01) |
| ***H01B 3/44*** | (2006.01) |
| ***H01B 13/00*** | (2006.01) |
| ***H01B 9/00*** | (2006.01) |

(52) U.S. Cl.
CPC ..... *H01B 13/142* (2013.01); *H01B 3/441* (2013.01); *H01B 9/006* (2013.01); *H01B 13/0036* (2013.01); *H01B 13/148* (2013.01)

(58) Field of Classification Search
CPC ..... H01B 13/142; H01B 3/441; H01B 9/006; H01B 13/0036; H01B 13/148
USPC ..... 174/113 R
See application file for complete search history.

(56) References Cited

U.S. PATENT DOCUMENTS

| | | | |
|---|---|---|---|
| 3,646,155 | A | 2/1972 | Henry |
| 4,117,195 | A | 9/1978 | Swarbrick et al. |

FOREIGN PATENT DOCUMENTS

| | | | |
|---|---|---|---|
| EP | 0193317 | A3 | 11/1987 |
| EP | 1254923 | A1 | 11/2002 |
| EP | 1256593 | A1 | 11/2002 |
| EP | 1306392 | A1 | 5/2003 |
| EP | 1849816 | A1 | 10/2007 |
| EP | 1985666 | A1 | 10/2008 |
| EP | 2508566 | A1 | 10/2012 |
| EP | 2562209 | A1 | 2/2013 |
| EP | 2657283 | A1 | 10/2013 |
| RU | 2372679 | C1 | 11/2009 |
| WO | 2003/088274 | A1 | 10/2003 |
| WO | 2004/053896 | A1 | 6/2004 |
| WO | 2005/003199 | A1 | 1/2005 |
| WO | 2006/101754 | A1 | 9/2006 |
| WO | 2007/071274 | A1 | 6/2007 |

OTHER PUBLICATIONS

Novel Polymer Crosslinking Chemistries for Cable Insulation; Paul J Caronia, 2014 Electrical insulation Conference, Jun. 11, 2014.*
The Chemistry of Polyethylene Insulation, Anthony Barlow, Quantum Chemical Corp., IEEE Electrical Insulation Magazine, Jan./Feb. 1991—vol. 7, No. 1.*
Office action for Chinese Patent Application No. 201680070112.1, dated Feb. 28, 2019.
Office action for Russian Patent Application No. 2018123332/05, dated Mar. 12, 2019.
Search Report for Russian Patent Application No. 2018123332/05, dated Mar. 20, 2019.

* cited by examiner

*Primary Examiner* — Timothy J Thompson
*Assistant Examiner* — Charles Pizzuto
(74) *Attorney, Agent, or Firm* — Tarolli, Sundheim, Covell & Tummino LLP

(57) ABSTRACT

The present invention relates to a process for manufacturing a power cable, which power cable comprises at least one core comprising a conductor and an expanded and cross-linked insulation layer surrounding said conductor, wherein said process comprises the steps a) to d): a) providing a blend of: a polymer composition comprising a polyolefin material, which polyolefin material bears silane moieties; a catalyst and a foaming system, wherein the provided blend will comprise at least 0.1% by weight of a foaming agent, with respect to the total weight of the polyolefin material; b) extruding a blend, as described in step a), on the conductor to form an insulation layer; c) foaming the insulation layer; and d) crosslinking the insulation layer; a power cable which is obtainable by the process, and use of the power cable.

13 Claims, 1 Drawing Sheet

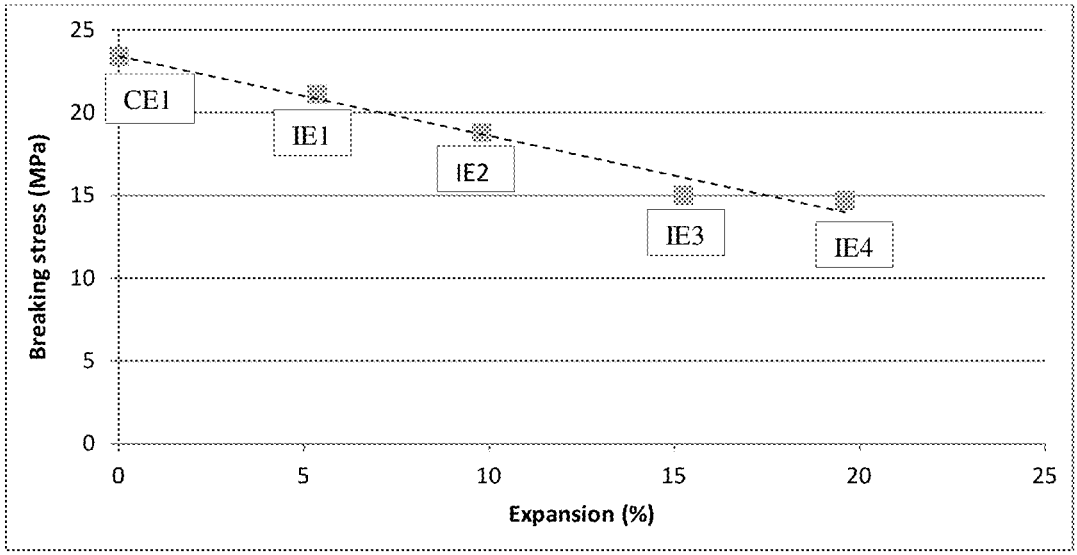
25
20
15
10
5
0
Breaking stress (MPa)
CE1
IE1
IE2
IE3
IE4
0
5
10
15
20
25
Expansion (%)

PROCESS FOR MANUFACTURING A POWER CABLE AND POWER CABLE OBTAINABLE THEREOF

FIELD OF INVENTION

The present invention relates to a new process for manufacturing a power cable, a power cable which is obtainable by the process, and use of the power cable.

BACKGROUND

In wire and cable (W&C) applications a typical cable comprises a conductor surrounded by one or more layers of polymeric materials. The cables are commonly produced by extruding the layers on a conductor. One or more of said layers are often crosslinked to improve e.g. deformation resistance at elevated temperatures, as well as mechanical strength and/or chemical resistance, of the layer(s) of the cable.

Crosslinking of the polymers can be achieved e.g. by free radical reaction using irradiation or using a crosslinking agent which is a free radical generating agent; or via hydrolysable silane groups present in the polymer using a condensation catalyst in the presence of water.

Power cables are defined to be cables transferring energy operating at any voltage level. The voltage applied to a power cable can be alternating (AC), direct (DC) or transient (impulse). Moreover, power cables are typically indicated according to their level of operating voltage, e.g. a low voltage (LV), a medium voltage (MV), a high voltage (HV) or an extra high voltage (EHV) power cable, which terms are well known. Power cable is defined to be a cable transferring energy operating at any voltage level, typically operating at voltage higher than 100 V. LV power cable typically operates at voltages of below 3 kV. MV and HV power cables operate at higher voltage levels and in different applications than LV cables. A typical MV power cable usually operates at voltages from 3 to 36 kV, and a typical HV power cable at voltages higher than 36 kV. EHV power cable operates at voltages which are even higher than typically used for HV power cable applications. LV power cable and in some embodiment medium voltage (MV) power cables usually comprise an electric conductor which is coated with an insulation layer. Typically MV and HV power cables comprise a conductor surrounded at least by an inner semiconductive layer, an insulation layer and an outer semiconductive layer, and in that order.

Silane-crosslinked materials have been used primarily as insulation layer in low voltage cables and as insulation and semiconductive layer in medium and to some extent also for high voltage cables.

Moreover, in WO 2007/071274 the need for a cable to be flexible in different applications is discussed. It is disclosed that in order to be correctly installed with simple and quick operations, a cable needs to be particularly flexible so that it can be inserted into the wall passages and/or wall conduits and follow the bends of the installation path without being damaged. And, it is also disclosed that increasing the flexibility of an electric cable can reduce the damages to the cable during customer installation caused by tearing or scraping actions. Furthermore, it is disclosed that the flexibility of the cable can be increased by providing the cable with an expanded insulating layer, with favorable results in the installation process of the cable.

Further, in WO 2007/071274 the observation "that if expanding and cross-linking a polyolefin is attempted, the expansion degree cannot in general be controlled, being either excessive or insufficient" is mentioned.

And, accordingly, WO 2007/071274 relates to a process for manufacturing an electric cable comprising an insulating coating of an expanded and silane-crosslinked polyolefin material, wherein the process comprises forming a blend of a polyolefin material, a silane-based crosslinking system and a foaming system.

However, there is still need for a process for manufacturing a power cable having an expanded and crosslinked insulation layer where process parameters may be optimized without having to take a reactive silane grafting process into consideration during extrusion.

DESCRIPTION OF THE INVENTION

A process for manufacturing a power cable having an expanded and crosslinked insulation layer has now been developed wherein the process parameters can be optimized without having to take a reactive silane grafting process into consideration during extrusion.

Thus, the present invention relates to a process for manufacturing a power cable, which power cable comprises at least one core comprising a conductor and an expanded and crosslinked insulation layer surrounding said conductor, wherein said process comprises the steps a) to d):

a) providing a blend of:

a polymer composition comprising a polyolefin material, which polyolefin material bears silane moieties, a catalyst and a foaming system, wherein the provided blend will comprise at least 0.1% by weight of a foaming agent, with respect to the total weight of the polyolefin material;

b) extruding a blend, as described in step a), on the conductor to form an insulation layer;

c) foaming the insulation layer; and d) crosslinking the insulation layer.

The process for manufacturing a power cable in accordance with the present invention involves no reactive grafting extrusion when extruding the cable, which has rendered said process a surprisingly broad processing window. The addition of the silane moieties onto the polymer chains of the polyolefin material is done in a separate step prior to said process for manufacturing a power cable. The silane moieties are added onto the polymer chains of the polyolefin material by peroxide grafting silane groups of the silane moieties onto the polymer chains, which is well described in U.S. Pat. Nos. 3,646,155 and 4,117,195, respectively, or by copolymerising silane groups of the silane moieties directly in a high pressure reactor, which is well described in EP0193317.

Said separate step of addition of the silane moieties onto the polymer chains of the polyolefin material enables a good control of both rheological properties and silane addition onto the polymer chain, before including the polyolefin material into said process for manufacturing a power cable. The process for manufacturing a power cable in accordance with the present invention makes it possible to optimize the process (e.g. screw design, pressure, temperature, output etc.), target mixing and homogenization of the components in the first part of the extruder followed by optimization of foaming properties (e.g. degree of foaming and cell structure, size and distribution in the cable insulation) in the end of the extruder, die and outlet from the extruder head.

Moreover, it has also been shown that with the present process for manufacturing a power cable it is possible to perform the extrusion step using ordinary extruders and still achieve acceptable output rates.

The present process for manufacturing a power cable does provide good control of quality of the final power cable, and the expanded and crosslinked insulation layer, as processing parameters can be optimized more for the foaming step when there is no need to take grafting into consideration.

Furthermore, the present process for manufacturing a power cable, with the benefits as described herein, has also been shown to produce less scrap and has enabled to run longer production campaign's without pre-crosslinking in the extruder, meaning less time for cleaning and more for production.

The process of the present invention, for manufacturing a power cable, may comprise any ordinary extruder, e.g. a single screw extruder.

The foaming degree might be controlled by changing extrusion parameters such as, for example, adjusting the temperature settings on the extruder and/or extruder head, line speed, screw speed, extruder die position, cooling bath position and cooling water temperature.

The crosslinking of the cable core occurs when exposed to water and is typically done in ambient condition or in a steam sauna or in a water tank having a temperature at about 70-90° C., for example about 80-90° C.

The power cable produced by the process of the present invention may be a LV, MV or HV cable, for example a LV or MV cable, e.g. a LV cable.

Further, the power cable core comprises a conductor and an expanded and crosslinked insulation layer surrounding said conductor. The power cable may comprise one or several power cable cores e.g. 1, 3, 4 or 5 power cable cores. The multi core power cables are typically twisted together before jacketing operation. In addition the power cable may comprise other layers which may add other properties to the final power cable. Such other layers may, e.g., be tapes, beddings, metal screens or jackets.

The polymer composition comprises a polyolefin material, which polyolefin material bears silane moieties, i.e. said polyolefin material comprises a crosslinkable polyolefin with hydrolysable silane groups.

The crosslinkable polyolefin of the polymer material may, for example, comprise a polyethylene with hydrolysable silane groups, or the crosslinkable polyolefin may, e.g., consist of a polyethylene with hydrolysable silane groups.

Further, the crosslinkable polyolefin of the polymer material may, for example, comprise a low density polyethylene with hydrolysable silane groups, or the crosslinkable polyolefin may, e.g., consist of a low density polyethylene with hydrolysable silane groups.

The hydrolysable silane groups may be introduced into the polyolefin by copolymerisation of, e.g., ethylene and silane group containing comonomers or by grafting, i.e. by chemical modification of the polyolefin by addition of silane-containing compounds mostly in a radical reaction. Both techniques are well known in the art.

Moreover, the crosslinkable polyolefin with hydrolysable silane groups may be obtained by copolymerisation. In the case of the polyolefin being, for example, polyethylene, the copolymerisation may be carried out with an unsaturated silane compound represented by the formula I $$R^1SiR^2_qY_{3-q} \quad (I)$$

wherein $R^1$ is an ethylenically unsaturated alkyl, alkyloxy or (meth)acryloxy alkyl group, $R^2$ is an aliphatic saturated alkyl group, Y which may be the same or different, is a hydrolysable organic group and q is 0, 1 or 2.

Special examples of the unsaturated silane compound are those wherein $R^1$ is vinyl, allyl, isopropenyl, butenyl, cyclohexanyl or gamma-(meth)acryloxy propyl; Y is methoxy, ethoxy, formyloxy, acetoxy, propionyloxy or an alkyl- or arylamino group; and $R^2$, if present, is a methyl, ethyl, propyl, decyl or phenyl group.

In an embodiment the unsaturated silane compound may be represented by the formula II $$CH_2{=}CHSi(OA)_3 \quad (II)$$

wherein A is a alkyl group having 1 to 8 carbon atoms, e.g. 1 to 4 carbon atoms.

In further embodiments of the present invention the silane compound may be, e.g., vinyl trimethoxysilane, vinyl bismethoxyethoxysilane, vinyl triethoxysilane, gamma-(meth) acryloxypropyltrimethoxysilane, gamma(meth)acryloxypropyltriethoxysilane, or vinyl triacetoxysilane.

Said copolymerisation may be carried out under any suitable conditions resulting in the copolymerisation of two monomers.

Moreover, the copolymerisation may be implemented in the presence of one or more other comonomers which can be copolymerised with the two monomers. Such comonomers include, for example, vinyl carboxylate esters, such as vinyl acetate and vinyl pivalate, alpha-olefins, such as propene, 1-butene, 1-hexane, 1-octene and 4-methyl-1-pentene, (meth)acrylates, such as methyl(meth)acrylate, ethyl(meth) acrylate and butyl(meth)acrylate, olefinically unsaturated carboxylic acids, such as (meth)acrylic acid, maleic acid and fumaric acid, (meth)acrylic acid derivatives, such as (meth) acrylonitrile and (meth)acrylic amide, vinyl ethers, such as vinyl methyl ether and vinyl phenyl ether, and aromatic vinyl compounds, such as styrene and alpha-ethyl styrene.

In still further embodiments of the present invention, said comonomers may be vinyl esters of monocarboxylic acids having 1-4 carbon atoms, such as vinyl acetate, and/or (meth)acrylate of alcohols having 1-4 carbon atoms, such as methyl(meth)-acrylate.

In even further embodiments of the present invention, the comonomers: butyl acrylate, ethyl acrylate and/or methyl acrylate are disclosed.

Two or more comonomers, such as any of the olefinically unsaturated compounds disclosed herein, may be used in combination. The term "(meth)acrylic acid" is intended to embrace both acrylic acid and methacrylic acid. The comonomer content of the copolymer may amount to 70% by weight of the copolymer, for example, about 0.5 to 35% by weight, e.g., about 1 to 30% by weight.

If a graft polymer is used, it may have been produced e.g. by any of the two methods described in U.S. Pat. Nos. 3,646,155 and 4,117,195, respectively.

In an embodiment of the present invention the polymer material, as described herein, comprises a low density polyethylene with hydrolysable silane groups, e.g., consists of a low density polyethylene with hydrolysable silane groups.

The polyolefin with hydrolysable silane groups, which is comprised in the polymer material in accordance with the present invention, may comprise 0.001 to 15% by weight of silane compound, for example, 0.01 to 5% by weight, e.g., 0.1 to 2% by weight.

Furthermore, the process of the present invention comprises providing a blend of: a polymer composition comprising a polyolefin material, which polyolefin material bears silane moieties, a catalyst and a foaming system.

The polymer composition according to the invention may further be comprised of blends between said polyolefin material and one or more further polyolefins with hydrolysable silane groups, as described herein, and/or one or more further polyolefins without any silane groups. The addition of extra polyolefins may be to adjust properties, e.g. foaming, hardness, flexibility and etc., of the final insulation layer. Said blends may be miscible or immiscible. A common addition may be to add a long chain branched polymer, like LDPE or long chain branched PP, with or without silane moieties to a short chain branched polymer, like LLDPE, HDPE or PP, with or without silane moieties in order to optimise properties.

Preferable 50 weight % or more the polymer comprising silane moiety is added in a blend in order to maintain good crosslinking properties.

The polymer composition according to the invention may further comprise various additives, for example, miscible thermoplastics, antioxidants, stabilizers, lubricants, fillers, pigments, carbon black and/or peroxides.

As antioxidant, a compound, or a mixture of compounds, may, for example, be used. The antioxidant may, suitably, be neutral or acidic compounds, and which compounds may, suitably, comprise a sterically hindered phenol group or aliphatic sulphur groups. Such compounds are disclosed in EP1254923 and these are suitable antioxidants for stabilisation of polyolefins containing hydrolysable silane groups which are crosslinked with a silanol condensation catalyst, e.g., an acidic silanol condensation catalyst. Other exemplified antioxidants are disclosed in WO2005003199.

Moreover, the antioxidant may be present in the polymer composition in an amount of from 0.01 to 3 wt %, e.g., 0.05 to 2 wt %, or, e.g., 0.08 to 1.5 wt %.

Further, said catalyst is a silanol condensation catalyst which enables crosslinking of a polyolefin material bearing silane moieties. Conventional catalysts which may be used are, for example, tin-, zinc-, iron-, lead- or cobalt-organic compounds such as dibutyl tin dilaurate (DBTDL) and dioctyl tin dilaurate (DOTDL).

Even further suitable catalysts include amidine condensation catalyst, together with carboxylic acid as crosslinking booster, see e.g. EP1985666;

secondary amine crosslinking catalyst, see e.g. EP1306392; and acidic silanol condensation catalysts (e.g. organic sulphonic acid) together with antioxidant, see e.g. WO2006101754.

Further examples of organic sulphonic acid as acidic silanol condensation catalysts are included in EP1849816 (sulphonic acid containing aromatic group), EP1254923 (sulphonic acid catalyst and stabiliser), EP2657283 (sulphonic acid and carboxylic acid) and EP 1256593 (sulphonic acid with hydrocarbyl substituted aromatic group).

Moreover, the foaming system comprises a foaming agent in such amount that the provided blend will comprise at least 0.1% by weight of a foaming agent, with respect to the total weight of the polyolefin material.

The foaming system may be a compound or a mixture of compounds comprising one or more foaming agents. Further, the foaming system may comprise any suitable exothermic and/or any suitable endothermic foaming agents.

By an "exothermic foaming agent" it is herein meant a compound or a mixture of compounds which is thermally unstable and which decomposes to yield gas and heat within a certain temperature interval.

Further, by an "endothermic foaming agent" it is herein meant a compound or a mixture of compounds which is thermally unstable and causes heat to be absorbed while generating gas within a certain temperature interval.

The foaming system may comprise any suitable foaming agent, which foaming agent may, for example, be an azo compound, e.g. azodicarbonamide, azobisisobutyronitrile, or diazoaminobenzene; based on hydrazine or hydrazide compound; or based on sodium citrate/citric acid, based on sodium bicarbonate or on combinations of sodium citrate/citric acid and sodium bicarbonate.

In one embodiment the foaming system comprises an exothermic foaming agent.

In a further embodiment the foaming system comprises an endothermic foaming agent.

The foaming agent may be present in an amount equal to or lower than 1% by weight with respect to the total weight of the polyolefin material.

In a further embodiment the foaming agent may be present in an amount of 0.05 to 0.8% by weight with respect to the total weight of the polyolefin material.

In still further embodiments the foaming agent is present in 0.1 to 0.6%, 0.15 to 0.5% or, alternatively, 0.2 to 0.4% by weight with respect to the total weight of the polyolefin material.

In a further embodiment, the foaming agent is present in an amount of from 0.15 to 0.5% by weight with respect to the total weight of the polyolefin material.

The foaming system may be added to the polyolefinic material as a masterbatch comprising a polymer material, for example, an ethylene homopolymer or copolymer such as ethylene/vinyl acetate copolymer (EVA), ethylene-propylene copolymer (EPR) and ethylene/butyl acrylate copolymer (EBA). Said masterbatch comprises an amount of foaming agent (exothermic or endothermic) of from 1% by weight to 80% by weight, e.g. 5% by weight to 50% by weight, for example, 10% by weight to 40% by weight, with respect to the total weight of the polymer material.

Moreover, the foaming system may further comprise at least one activator (a.k.a. kicker). Suitable activators for the foaming system of the invention may be transition metal compounds.

Further, the foaming system of the process of the invention may further comprise at least one nucleating agent. Said nucleating agent may be an active nucleator.

In a first embodiment of the process for manufacturing a power cable, the polyolefin material bearing silane moieties and the foaming system are combined together suitably by compounding in a conventional manner, e.g. by extrusion with a screw extruder or a kneader. The obtained meltmixture of the polyolefin material bearing silane moieties and the foaming system may then suitably be pelletised. Further, the obtained pellets can be of any size and shape. The catalyst is then combined together with said pellets either by direct feeding the catalyst and said pellets into the extruder or by adding the catalyst, for example, in the form of a masterbatch to said pellets prior to the extrusion step, or, alternatively, in the extrusion step, for example, by separately feeding of the catalyst masterbatch into the extruder.

In a second embodiment of the process for manufacturing a power cable, the providing of said blend comprises that the foaming system is combined with the catalyst, a carrier resin and, for example, other additives to form a masterbatch. The carrier resin in the masterbatch is, for example, a polyolefin material, e.g., a low density polyethylene resin. The foaming system, the catalyst, the carrier resin and, for example, other additives may, e.g., be combined together by compounding in a conventional manner, e.g., by extruding the components with a screw extruder or a kneader. The obtained meltmixture of the masterbatch may, for example, be pelletised. The masterbatch may then be combined with the polyolefin material bearing silane moieties to provide the blend either before the extrusion step or in the extrusion step.

In yet another embodiment of the process for manufacturing a power cable, the providing of said blend comprises the combination of the polymer composition or an addition of part of the other component(s) of the blend, such as the foaming system, the catalyst or additive(s), or any mixture thereof, can be carried out during the process for manufacturing, e.g. in a cable production line, for example, in a mixer preceding the cable extruder or in the cable extruder, or in both. The obtained blend is used to form at least one insulation layer.

The process for manufacturing the power cable comprises extrusion of the provided blend on the conductor to form an insulation layer.

A suitable process in accordance with the process for manufacturing a power cable, as described herein, comprises the step of applying on a conductor, e.g., by (co)extrusion, one or more layers, wherein at least one layer comprises, for example, consists of, the provided blend of: a polymer composition comprising a polyolefin material, which polyolefin material bears silane moieties, a catalyst and a foaming system, wherein the provided blend will comprise at least 0.1% by weight of a foaming agent, with respect to the total weight of the polyolefin material.

The term "(co)extrusion" means herein that in case of two or more layers, said layers can be extruded in separate steps, or at least two or all of said layers can be coextruded in a same extrusion step, as well known in the art. The term "(co)extrusion" means herein also that all or part of the layer(s) are formed simultaneously using one or more extrusion heads. For instance a triple extrusion can be used for forming three layers. In case a layer is formed using more than one extrusion heads, then for instance, the layers can be extruded using two extrusion heads, the first one for forming the inner semiconductive layer and the inner part of the insulation layer, and the second head for forming the outer insulation layer and the outer semiconductive layer. (Co) extrusion can be effected in any conventional cable extruder, e.g. a single or twin screw extruder.

As well known a meltmix of the provided blend, or component/s thereof, may be applied to form a layer. Meltmixing means mixing above the melting point of at least the major polymer component(s) of the obtained mixture and is carried out, for example, without limiting to, in a temperature of at least 15° C. above the melting or softening point of polymer component(s). The meltmixing can be carried out in the cable extruder or in a mixer, e.g. kneader, preceding the extruder, or in both.

Further, the process for manufacturing the power cable comprises foaming the insulation layer, said foaming occurs when the melt of the provided blend leaves the cable extruder as this results in a pressure drop as the atmospheric pressure is lower than the pressure inside the extruder. When the melt pressure is reduced to atmospheric pressure the gas formed in the extruder by the foaming system will no longer be dissolved in the melt. Instead, the gas will form bubbles, i.e. cells, in the polymer melt which will grow until the melt is cooled down to a temperature where the viscosity of the melt is too high to allow further cell growth. The resulting insulation will be foamed which means that it contains dispersed gas bubbles, i.e. gas cells.

For the extrusion of a blend, in step a), on the conductor, in the process for manufacturing a power cable in accordance with the present invention, as described herein, EP2562209 A1 is here also included as reference.

The process according to the present invention comprises also crosslinking of the insulation layer.

The crosslinking is carried out in the presence of a catalyst, such as a silanol condensation catalyst, and water. Accordingly, the silane group(s) containing units present in the silane moieties of the polyolefin material are hydrolysed under the influence of water in the presence of the silanol condensation catalyst resulting in the splitting off of alcohol and the formation of silanol groups, which are then crosslinked in a subsequent condensation reaction wherein water is split off and Si—O—Si links are formed between other hydrolysed silane groups present in the polyolefin material. The resulting crosslinked insulation layer in accordance with the present invention has a typical network, i.a. interpolymer crosslinks (bridges), as well known in the field. The silanol condensation catalyst which is suitable for the present invention may either be well known and commercially available, or can be produced according to, or analogously to, as described in any literature in the field.

For the crosslinking of the insulation layer EP 2508566 A1 is here also included as reference.

In a further embodiment, the process according to the present invention comprises said foaming system which comprises 0.1 to 0.7% by weight of the foaming agent.

In still a further embodiment, the process according to the present invention comprises said foaming system which comprises 0.1 to 0.5% by weight of the foaming agent.

A further embodiment according to the present invention comprises said polymer material which comprises 0.001 to 15% by weight of silane compound.

In further embodiments of the present invention said polymer material comprises 0.01 to 5% by weight of silane compound, or 0.1 to 2% by weight of silane compound.

In further embodiments of the present invention said crosslinking of the insulation layer is achieved in ambient condition, in steam sauna or, alternatively, in water bath.

The present invention does also relate to a power cable which is as described herein, and which power cable is obtainable by the process also as described herein.

In an embodiment according to the present invention said insulation layer, as described herein, has an expansion degree of 3 to 40%.

In still an embodiment of the present invention said insulation layer, as described herein, is in contact with the conductor.

In a further embodiment of the present invention the power cable, as described herein, is a low voltage cable or a medium voltage cable.

In an even further embodiment of the present invention the power cable, as described herein, comprises three cores wherein each core comprises a conductor.

In still an embodiment of the present invention said insulation layer, as described herein, has an expansion degree of from 5% to 30%.

In still a further embodiment of the present invention said insulation layer, as described herein, has an expansion degree of from 5% to 25%.

In a further embodiment of the present invention, the insulation layer, as described herein, has an average cell size equal to or lower than 150 μm. The cells contain gas.

In even a further embodiment of the present invention, the insulation layer, as described herein, has an average cell size equal to or lower than 100 μm.

The present invention does also relate to use of the power cable, as described herein.

The following examples illustrate, but intend not to limit, the present invention.

LEGEND OF FIGURE

FIG. 1 shows breaking stress as a function of expansion degree

EXAMPLES

1. Methods a. Hot Set Elongation

The crosslinking of the polymer composition, i.e. the insulation layer of the present invention, was determined according to IEC-60811-2-1 (hot set method and permanent set) by measuring the thermal deformation at 200° C. and a load of 0.2 MPa. The conductor was removed from the insulation, i.e. from the insulation layer of the present invention, resulting in a tubular insulation specimen. Reference lines were marked 20 mm apart on the tubular test specimen and the inner and outer diameters were measured. The test samples, i.e. originating from the insulation layer of the present invention, were fixed vertically from upper end thereof in an oven heated to 200° C. and a load of 0.2 MPa was attached to the lower end of the test samples. The distance between the upper and lower clamps holding a sample and the load, respectively, was 5 mm. After 15 min in the oven, the distance between the pre-marked lines was measured and the percentage of hot set elongation calculated, hot set elongation %. For permanent deformation %, sometimes also referred to as permanent set, the tensile force (weight) was removed from the test sample and after recovery in 200° C. for 5 minutes the sample was taken out of the oven and let to cool in room temperature to ambient temperature. The permanent set % was calculated from the distance between the marked lines after cooling. The reported values are the average values from three tests.

b. Tensile Testing According to EN 60811-100

The tensile strength and elongation at break of 150 mm long tubular insulation test specimen from stripped cable samples, i.e. originating from the insulation layer of the present invention, were measured in accordance with ISO 527-1:1993 at 23° C. and 50% relative humidity on a Doli-Alwetron TCT 25 tensile tester at a speed of 250 mm/min. A digital extensiometer with a starting distance of 50 mm was used for determination of the elongation at break. The starting distance between the clamps of the tensile tester was 115 mm. A 1 kilo Newton load cell was used for the measurements. The samples were conditioned for minimum 16 hours at 23+/−2° C. and 50% relative humidity prior testing. The average value out of 6-10 samples is reported herein.

c. MFR

The melt flow rate MFR2 was measured in accordance with ISO 1133 at 190° C. and a load of 2.16 kg.

d. Density

The density was measured according to ISO 1183A on samples prepared according to ISO1872-2.

2. Materials

The polyolefin material which bears silane moieties and is comprised in the polymer composition used in the process according to the present invention, is in the examples herein an ethylene vinylsilane copolymer Visico LE4423™, i.e. a crosslinkable polyolefin with hydrolysable silane groups, supplied by *Borealis* having a density of 922.5 kg/m$^3$, an $MFR_{2.16}$ of 1.0 g/10 min and VTMS comonomer content is 1.1% by weight.

The catalysts used in the process according to the present invention are comprised in catalyst masterbatches, which are in the examples herein:

the commercially available master batch of an organotin catalyst, i.e. LE4438, which catalyses silane crosslinking reactions, supplied by *Borealis*, and the commercially available master batch of an silane condensation catalyst, i.e. LE4476, wherein the active catalyst component is based on sulfonic acid, supplied by *Borealis*.

The foaming system used in the process according to the present invention is in the examples herein: an azodicarbonamide (ADC) masterbatch containing 15% by weight ADC in low density polyethylene. Available commercially as nCore 7155-M1-300 from the supplier Americhem.

3. Sample Preparation

Prior to testing, the foaming system used in the inventive examples was compounded into a polyolefin material bearing silane moieties using a BUSS AG co-kneader type PR46B-11D/H1 (50 mm screw). Compounding is a type of melt mixing of polymers where one or more polymers and/or additives are mixed in molten state. It is often used for dispersion and distribution of additives and fillers in a polymer melt. 2% by weight of the foaming system nCore 7155-M1-300 was mixed into 98% by weight LE4423-5E05 in the compounding process.

The blends used for producing the exemplified foamed insulation samples were obtained by taking the mix containing the polyolefin material bearing silane moieties and the foaming system and dry blending said mix with 5% by weight of a catalyst masterbatch containing silane crosslinking catalyst and other additives. The blends were then extruded on 1.5 mm$^2$ solid Cu conductor preheated to 110° C. on a Nokia-Maillefer 60 mm extruder. The extruded cable was cooled in a 50° C. water bath positioned 60 cm from the die exit. Temperature settings, insulation thickness, die size and line speed for each sample can be seen in Table 1. The cable samples were after extrusion crosslinked for 24 hours in a 90° C. water bath, resulting in the insulation layer of the present invention, prior to hot set and mechanical testing.

The comparative example CE1 was produced in the same way, except that no foaming system was added to the polyolefin material bearing silane moieties, nor was any compounding performed.

TABLE 1

| Sample | CE1 | IE1 | IE2 | IE3 | IE4 |
|---|---|---|---|---|---|
| Insulation material | LE4423-SE05 | LE4423-SE05 containing 2% by weight nCore 7155-M1-300 | LE4423-SE05 containing 2% by weight nCore 7155-M1-300 | LE4423-SE05 containing 2% by weight nCore 7155-M1-300 | LE4423-SE05 containing 2% by weight nCore 7155-M1-300 |

TABLE 1-continued

| Sample | CE1 | IE1 | IE2 | IE3 | IE4 |
|---|---|---|---|---|---|
| Catalyst masterbatch (5% by weight added to the insulation material) | LE4438 | LE4438 | LE4438 | LE4438 | LE4476 |
| Insulation thickness (mm) | 0.72 | 0.73 | 0.46 | 0.46 | 0.49 |
| Expansion (%) | 0 | 10 | 19 | 5 | 12 |
| Die (mm) | 2.8 | 2.8 | 2.3 | 2.3 | 2.3 |
| Line speed (m/min) | 75 | 75 | 75 | 110 | 75 |
| Temp settings Z1/Z2/Z3/Z4/Z5, H1/H2/H3 (° C.) | 150/160/170/170/170, 170/170/170 | 190/200/210/210/210, 210/210/210 | 190/200/210/210/210, 210/210/210 | 190/200/210/210/210, 210/210/210 | 190/200/210/210/210, 210/210/210 |
| Hot set elongation (%) | 41.4 | 41.9 | 42.5 | 41.9 | Fail |
| Permanent deformation (%) | −2.3 | −1.7 | −2.5 | −2 | Fail |
| Stress at break (MPa) | 23.4 | 18.8 | 14.7 | 21.1 | 15.0 |
| Strain at break (%) | 417 | 401 | 345 | 403 | 479 |
| Average number of cells in insulation cross section | 0 | 8 per 0.73 mm | 3 per 0.46 mm | 8 per 0.46 mm | 5 per 0.49 mm |
| Average cell size (μm) | — | 35 | 100 | 25 | 60 |

Table 1 shows inventive examples, IE1-IE4, i.e. the insulation layer of the present invention, compared to solid EVS copolymer insulation, i.e. the comparative example, CE1. Hot set was tested according to EN 60811-50 and tensile testing according to EN 60811-100. Results from these tests are presented in Table 1.

The foamed insulation can be seen as a composite material consisting of gas cells in a polymeric matrix. One would expect that hot set would be higher for foamed samples as foaming results in less polymeric material in the insulation that can bear the load during the measurement. It is thus very surprising to see that the hot set values for the inventive samples IE1, IE2 and IE3, which were crosslinked with an organotin catalyst, are equal to the solid CE1 crosslinked with the same catalyst under the same conditions. The foamed inventive example 1E4 containing a sulphonic acid catalyst gives a strain break during hot set testing. This result was expected as decomposition of the blowing agent azodicarbonamide results in alkaline decomposition products and it is known that the activity of sulphonic acid catalysts are reduced in presence of alkaline substances.

The average cell size and the number of cells per insulation cross-section can also be seen in Table 1. There is a large variation in cell size and number of cells between the different insulation samples: IE2 contains few large cells while IE1 and IE3 contain more and smaller cells. Surprisingly, the cell size and number of cells does not seem to have any impact on tensile properties, it is only the degree of expansion that seem to be important. FIG. 1 shows breaking stress as a function of expansion degree, and it can here be seen that stress at break decreases linearly with expansion degree seemingly independent of how the air is divided inside the insulation.

Thus, it has, accordingly, hereby been shown that an expanded and crosslinked insulation layer comprising an expanded and crosslinked blend, in accordance with the present invention as described herein, meets the general hot set and tensile requirements for cable insulation materials.

The invention claimed is:

1. Process for manufacturing a power cable, which power cable comprises at least one core comprising a conductor and an expanded and crosslinked insulation layer surrounding said conductor, wherein said process comprises steps a) to d):

a) providing a blend of:

a polymer composition comprising a polyolefin material, which polyolefin material bears silane moieties, a catalyst and a foaming system, wherein the provided blend will comprise at least 0.1% by weight of a foaming agent, with respect to a total weight of the polyolefin material;

b) extruding the blend, as described in step a), on the conductor to form an insulation layer;

c) foaming the insulation layer; and d) crosslinking the insulation layer.

2. The process according to claim 1, wherein the foaming system comprises 0.1 to 0.7% by weight of the foaming agent.

3. The process according to claim 1, wherein the polymer material comprises a low density polyethylene with hydrolysable silane groups.

4. The process according to claim 1, wherein the polyolefin material comprises 0.001 to 15% by weight of silane compound.

5. A power cable which is defined as in, and is obtainable by the process according to claim 1.

6. The power cable according to claim 5, wherein the insulation layer has an expansion degree of 3 to 40%.

7. The power cable according to claim 5, wherein the insulation layer is in contact with the conductor.

8. The power cable according to claim 5, which is a low voltage cable or a medium voltage cable.

9. The power cable according to claim 5, which comprises three cores each comprising a conductor.

10. The power cable according to claim 5, wherein the insulation layer has an expansion degree of from 5% to 30%.

11. The power cable according to claim 5, wherein the insulation layer has an expansion degree of from 5% to 25%.

12. The power cable according to claim 5, wherein the insulation layer has an average cell size equal to or lower than 150 μm.

13. The power cable according to claim 5, wherein the insulation layer has an average cell size equal to or lower than 100 μm.

* * * * *